US010004266B2

(12) United States Patent
Liu

(10) Patent No.: US 10,004,266 B2
(45) **Date of Patent: *Jun. 26, 2018**

(54) ELECTRONIC CIGARETTE

(71) Applicant: HUIZHOU KIMREE TECHNOLOGY CO., LTD. SHENZHEN BRANCH, Shenzhen, Guangdong (CN)

(72) Inventor: Qiuming Liu, Guangdong (CN)

(73) Assignee: HUIZHOU KIMREE TECHNOLOGY CO., LTD. SHENZHEN BRANCH, Shenzhen, Guangdong (CN)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/295,873

(22) Filed: Oct. 17, 2016

(65) Prior Publication Data

US 2017/0127724 A1 May 11, 2017

Related U.S. Application Data

(63) Continuation of application No. PCT/CN2014/075358, filed on Apr. 15, 2014.

(51) Int. Cl.
*A24F 47/00* (2006.01)

(52) U.S. Cl.
CPC ..... *A24F 47/008* (2013.01)

(58) Field of Classification Search
CPC ..... A24F 47/008; A24F 47/002; A24F 47/00; A61M 11/044; A61M 11/042;
(Continued)

(56) References Cited

U.S. PATENT DOCUMENTS 4,735,217 A * 4/1988 Gerth ..... A24F 47/008 128/203.17
2010/0229881 A1 9/2010 Hearn
(Continued)

FOREIGN PATENT DOCUMENTS

CN 202941411 U 5/2013
CN 203314106 U 12/2013
(Continued)

OTHER PUBLICATIONS

International Search Report for PCT/CN2014/075358, dated Dec. 30, 2014, ISA/CN.

*Primary Examiner* — Gary Paumen
(74) *Attorney, Agent, or Firm* — U.S. Fairsky LLP; Yue Xu

(57) ABSTRACT

An electronic cigarette body is provided with a functional element, a sleeve and a locating member. The sleeve is slidably connected to the electronic cigarette body and configured to cover the functional element. The locating member is fixed on the electronic cigarette body and located between the sleeve and the electronic cigarette body, and is configured to make the sleeve to be slidably connected to the electronic cigarette body. Two ends of the sleeve are provided with non-metallic stopping members respectively. The locating member is located between the non-metallic stopping members and is configured to abut against the non-metallic stopping members to limit a sliding distance of the sleeve and prevent the sleeve from sliding off the electronic cigarette body. The electronic cigarette prevents the functional element from being touched by mistake or hit due to being exposed.

16 Claims, 4 Drawing Sheets

(58) Field of Classification Search
CPC ..... A61M 11/041; A61M 15/0035; A61M 15/06; A61M 15/0025
See application file for complete search history.

(56) References Cited

U.S. PATENT DOCUMENTS

| | | | | |
|---|---|---|---|---|
| 2013/0284194 | A1 | 10/2013 | Newton | |
| 2015/0007833 | A1* | 1/2015 | Orvis ..... | A24F 13/14 131/328 |
| 2016/0242463 | A1 | 8/2016 | Liu | |

FOREIGN PATENT DOCUMENTS

| | | | |
|---|---|---|---|
| CN | 203388261 | U | 1/2014 |
| CN | 203503722 | U | 3/2014 |
| CN | 203523809 | U | 4/2014 |

* cited by examiner

ELECTRONIC CIGARETTE

CROSS-REFERENCES TO RELATED APPLICATION

This application is a continuation of PCT/CN2014/075358, filed on Apr. 15, 2014 and titled "ELECTRONIC CIGARETTE", which is incorporated herein by reference in its entirety.

FIELD

The present application relates to the technical field of electronic cigarettes, in particular to an electronic cigarette, wherein the surface of an electronic cigarette body is not scratched and a functional element on the surface of the electronic cigarette body can be protected.

BACKGROUND

When manufacturers design an electronic cigarette, for enabling users to enjoy more functions, many functional components, such as a display screen displaying the status of the electronic cigarette and a button arranged on an electronic cigarette body by which the user can control the electronic cigarette, are provided on an electronic cigarette body, and these components bring great joy and pleasure to the electronic cigarette user.

However, while these functional components arranged on the electronic cigarette body bring joy and pleasure to the users, the button or display screen arranged on a surface of the electronic cigarette also brings many troubles to the user at the same time. Because these functional components are exposed outside, they are apt to be touched by mistake or broken due to being hit when the user carries the electronic cigarette, and thus the electronic cigarette can not normally work.

SUMMARY

An electronic cigarette is provided according to the present application, wherein a surface of an electronic cigarette body is not scratched and a functional element on the surface of the electronic cigarette body can be protected.

The technical issue solved by the present application is that a functional element, which is exposed outside an electronic cigarette body, is apt to be touched by mistake or broken due to being hit, thus the electronic cigarette can not normally work. The technical solutions of the present application employed to solve the above-mentioned technical issue are as follows.

An electronic cigarette, including an electronic cigarette body, wherein, the electronic cigarette body is provided with a functional element, a sleeve and a locating member;

the sleeve is slidably connected to the electronic cigarette body and configured to cover the functional element; the locating member is fixed on the electronic cigarette body and located between the sleeve and the electronic cigarette body, and is configured to make the sleeve to be slidably connected to the electronic cigarette body;

two ends of the sleeve are provided with non-metallic stopping members respectively, which protrude from an inner surface of the sleeve and are in contact with a surface of the electronic cigarette body; and the locating member is located between the non-metallic stopping members and is configured to abut against the non-metallic stopping members to limit a sliding distance of the sleeve and prevent the sleeve from sliding off the electronic cigarette body.

In the electronic cigarette according to the present application, the two ends of the sleeve are further respectively provided with magnetic rings protruding from the inner surface of the sleeve;

each magnetic ring is provided with a hollow cavity; an inside of the hollow cavity is provided with the non-metallic stopping member which protrudes from the hollow cavity and is connected to the surface of the electronic cigarette body; and the locating member is a magnet connected to the magnetic ring by a magnetic attraction force, and is configured to obstruct a free sliding of the sleeve on the electronic cigarette body when the sleeve uncovers or covers the functional element.

In the electronic cigarette according to the present application, a middle portion of the magnetic ring is provided with at least four T-shaped hollow cavities; and an inside of each T-shaped hollow cavity is provided with the non-metallic stopping member which protrudes from the T-shaped hollow cavity and is in contact with the surface of the electronic cigarette body.

In the electronic cigarette according to the present application, the locating member is provided with at least two sliding grooves;

the sleeve is further provided with sliding rails which match with the sliding grooves and axially slide relative to the electronic cigarette body;

the non-metallic stopping members are arranged at two ends of the sliding rails; and each sliding rail is arranged in an axial direction of the electronic cigarette body.

In the electronic cigarette according to the present application, the sleeve is provided with an opening via which the user uses the functional element;

the sleeve is provided with at least two circumferential grooves in a circumference direction of the electronic cigarette body; the locating member is provided with circumferential bosses matching with the circumferential grooves; and the sleeve is slidable in the circumferential direction of the electronic cigarette body by the circumferential grooves matching with the circumferential bosses.

In the electronic cigarette according to the present application, the sleeve is further provided with non-metallic stopping members which are located at two sides of the opening respectively and are in the axial direction of the electronic cigarette body; and the electronic cigarette body is further provided with a locating member which matches with the non-metallic stopping members and is configured to restrict a sliding range of the sleeve.

In the electronic cigarette according to the present application, the functional element includes a button and/or a display screen.

In the electronic cigarette according to the present application, the non-metallic stopping member is silica gel or rubber.

In the electronic cigarette according to the present application, the locating member includes an upper portion and a lower portion;

the upper portion is in contact with the sleeve and is silica gel or rubber; and the lower portion is connected to the electronic cigarette body and is made of magnetic material.

In the electronic cigarette according to the present application, the two ends of the sleeve are provided with grooves each having a trapezoid cross section and configured to receive the non-metallic stopping members; and the non-metallic stopping members and the sleeve are connected in a detachable manner.

In the electronic cigarette according to the present application, the electronic cigarette further includes a smoking end, a liquid container configured to contain a cigarette liquid, an atomizing assembly for atomizing the cigarette liquid and a battery rod assembly for supplying power to the atomizing assembly;

the liquid container is arranged on an end of the electronic cigarette body away from the smoking end; and the functional element is arranged on the atomizing assembly or the battery rod assembly.

In the electronic cigarette according to the present application, the atomizing assembly is located between the battery rod assembly and the liquid container, and the smoking end is located at an outside of an end of the battery rod assembly or is located at an middle portion of the battery rod assembly or at a position which is away from the atomizing assembly on the battery rod assembly.

In the electronic cigarette according to the present application, the liquid container and the atomizing assembly are detachably connected;

and/or the atomizing assembly and the battery rod assembly are detachably connected.

In the electronic cigarette according to the present application, the atomizing assembly and the battery rod assembly are coaxially arranged.

In the electronic cigarette according to the present application, the atomizing assembly includes a heating wire assembly configured to atomize the cigarette liquid; and a liquid guide device configured to convey the cigarette liquid in the liquid container to the heating wire assembly to be atomized.

In the electronic cigarette according to the present application, a surface of the atomizing assembly or the battery rod assembly is provided with the sleeve configured to cover the functional element.

According to the above technical solutions, the present application has the following advantages. The electronic cigarette body according to the present application is provided with the functional element, the sleeve and the locating member. The sleeve is slidably connected to the electronic cigarette body and configured to cover the functional element and has a protective function. The locating member is fixed on the electronic cigarette body and located between the sleeve and the electronic cigarette body, and is configured to make the sleeve to be slidably connected to the electronic cigarette body; two ends of the sleeve are provided with non-metallic stopping members respectively, which protrude from an inner surface of the sleeve and are in contact with a surface of the electronic cigarette body; and the locating member is located between the non-metallic stopping members and is configured to abut against the non-metallic stopping members to limit a sliding distance of the sleeve and prevent the sleeve from sliding off the electronic cigarette body. The non-metallic stopping member may be silica gel or rubber. Since the silica gel or rubber is soft and wear-resistant, when they are in contact with the surface of the electronic cigarette body, no matter in a sliding situation or a non-sliding situation, the surface of the electronic cigarette body is not scratched. The sleeve is prevented, by the non-metallic stopping members abutting against the electronic cigarette body, from sliding freely, thereby improving the reliability. The electronic cigarette according to the present application prevents the functional element from being touched by mistake or hit due to being exposed, thus the electronic cigarette can normally work. Moreover, the sleeve is connected to the electronic cigarette body by the non-metallic stopping member, and the non-metallic stopping member does not scratch or damage the surface of the electronic cigarette body, thereby not only facilitating user's use, improving the user's experience but also prolonging the service life of the electronic cigarette. The sleeve is slidably sleeved on the electronic cigarette body and protects the functional elements, and the shape and structure features of the electronic cigarette body are skillfully combined, thus the entire electronic cigarette not only has a compact structure and a convenient assembly, but also is convenient to use because the electronic cigarette can be used after rotating the sleeve in the circumferential direction of the electronic cigarette body or pulling the sleeve in the axial direction of the electronic cigarette body. By the sleeve covering and protecting the functional elements, children are prevented from inhaling the electronic cigarette by mistake, and the safety of the electronic cigarette is increased, and the situation is avoided that the children playing the electronic cigarette as a toy open the functional element and inhale the electronic cigarette.

BRIEF DESCRIPTION OF THE DRAWINGS

For more clearly illustrating embodiments of the present application or the technical solution in the prior art, drawings referred to describe the embodiments or the prior art will be briefly described hereinafter. Apparently, the drawings in the following description are only several embodiments of the present application, and for the person skilled in the art other drawings may be obtained based on these drawings without any creative efforts.

DETAILED DESCRIPTION

The technical solutions in the embodiments of the present application will be described clearly and completely hereinafter in conjunction with the drawings in the embodiments of the present application. Apparently, the described embodiments are only a part of the embodiments of the present application, rather than all embodiments. Based on the embodiments in the present application, all of other embodiments, made by the person skilled in the art without any creative efforts, fall into the scope of the present application.

Figure 1:
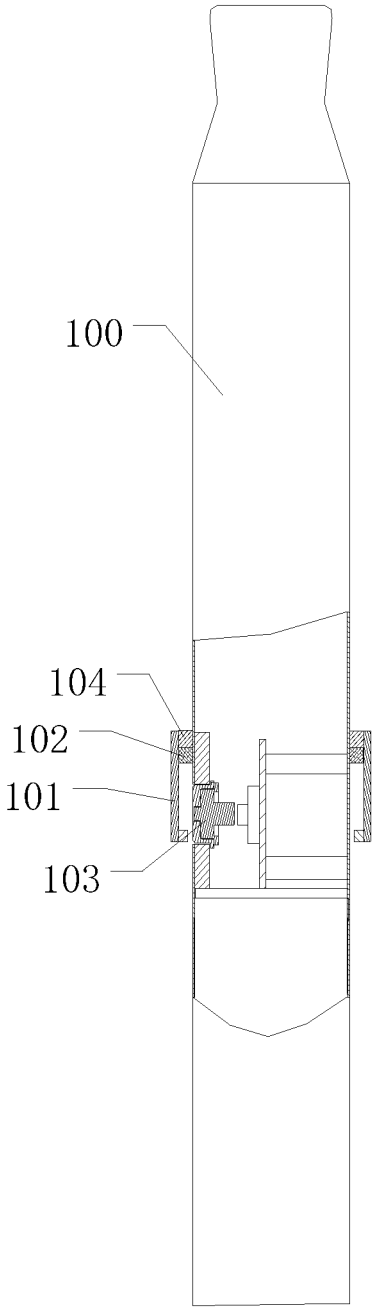
FIG. 1 is a schematic view showing the overall structure of an electronic cigarette according to the present application.

An electronic cigarette is provided according to the present application, wherein a surface of an electronic cigarette body is not scratched and a functional element on the surface of the electronic cigarette body can be protected. Reference is made to FIG. 1, an electronic cigarette body 100 is provided with a functional element 103, a sleeve 101 and a locating member 102.

The sleeve 101 is slidably connected to the electronic cigarette body and configured to cover the functional element 103.

The locating member 102 is fixed on the electronic cigarette body 100, is located between the sleeve 101 and the electronic cigarette body 100 and is configured to make the sleeve 101 to be slidably connected to the electronic cigarette body 100.

Two ends of the sleeve 101 are provided with non-metallic stopping members 104 respectively, which protrude from an inner surface of the sleeve 101 and are in contact with the surface of the electronic cigarette body 100.

The locating member 102 is located between the non-metallic stopping members 104 and is configured to abut against the non-metallic stopping members 104 to limit a sliding distance of the sleeve 101 and prevent the sleeve 101 from sliding off the electronic cigarette body 100.

In the present application, two ends of the sleeve 101 are each provided with a non-metallic stopping member 104 which is in contact with the surface of the electronic cigarette body 100. The non-metallic stopping member 104 may be silica gel or rubber, that is, the non-metallic stopping member 104 may be made of silica gel or rubber. Since the silica gel or rubber is soft and wear-resistant, when in contact with the surface of the electronic cigarette body 100, the non-metallic stopping member 104 may not scratch the surface of the electronic cigarette body 100 no matter in a sliding situation or a non-sliding situation. By the non-metallic stopping members 104 abutting against the electronic cigarette body 100, the sleeve 101 is prevented from sliding freely, thus improving the reliability.

In the present application, the locating member 102 is fixedly connected to an exterior of the electronic cigarette body 100. Of course, the locating member 102 may be movably arranged or arranged inside the electronic cigarette body 100. The function of the locating member 102 is to make the sleeve 101 to be slidably connected to the electronic cigarette body 100. A specific connecting manner to the electronic cigarette body 100 is not limited herein.

As shown in FIG. 1, the whole sleeve 101 is sleeved on the exterior of the electronic cigarette body 100 and covers the functional element 103.

Under the action of the user's pushing force, the sleeve 101 slides on the electronic cigarette body 100 via the non-metallic stopping member 104 to uncover the functional element 103, thus the user can use the functional element 103 normally.

A length of the sleeve 101 along the electronic cigarette body 100 may be set to be equal to or larger than a length of the functional element 103 along the electronic cigarette body 100. The largest length should not exceed one-third of a length of the electronic cigarette body 100, and a specific length is not limited herein.

The locating member 102 may have an annular shape arranged around the circumference of the electronic cigarette body 100. The number of the locating member 102 may be two, three or four, and a specific number is not limited herein.

The annular shape of the locating member 102 may be a disconnected ring or a complete ring.

The locating member 102 may be arranged in the axial direction of the electronic cigarette body 100, a length of the locating member 102 is equal to or smaller than the length of the sleeve 101 along the electronic cigarette body 100, and the smallest length can not be smaller than two thirds of the length of the sleeve 101. A specific shape of the locating member 102 is not limited herein.

In the present application, the sleeve 101 and the locating member 102 may be in an interference fit and are slidable with respect to each other with a fit surface being smooth, so that the sleeve 101 can have a better protection effect. During the using process, a sliding direction of the sleeve 101 can be controlled by the user.

In the present application, the functional element 103 includes a button and/or a display screen and further includes some modules or components, which must be arranged on the exterior of the electronic cigarette body 100 to add functions to the electronic cigarette, and thus requires to be protected. Specific elements or components are not limited herein.

In the present application, the non-metallic stopping member 104 may be made of material such as silica gel or rubber, and a specific material is not limited herein.

In the present application, the locating member 102 preferably includes an upper portion and a lower portion. The upper portion is in contact with the sleeve 101 and is made of silica gel or rubber. The lower portion is connected to the electronic cigarette body and is made of magnetic material such as magnet, or iron, cobalt, nickel or their alloy. The upper portion of the locating member 102 is in contact with the sleeve 101 and a contacting surface is rubber material such as silica gel or rubber, which are not limited herein, so that during the sliding process, the sleeve 101 is not apt to be worn and scratched when in contact with the locating member 102. The lower portion is made of the magnetic material. Two ends of the sleeve 101 may be each provided with a magnet, and the magnet and the magnetic material of the locating member 102 generate a magnetic force to fix the sleeve 101 reliably.

In the present application, the two ends of the sleeve 101 may be provided with both the magnet and the non-metallic stopping member 104. By slidably connecting the sleeve 101 to the electronic cigarette body 100, when the user needs to use the functional element 103, the sleeve 101 is removed, and is reliably fixed by the magnetic force generated between the locating member 102 and the sleeve 101, thereby preventing the sleeve 101 from sliding freely and adversely affecting user's use; when the user does not need to use the functional element 103, the sleeve 101 covers the functional element 103 and has a protection function, and is reliably fixed by the magnetic force. In the present application, the functional element 103 is avoided from being exposed outside and is prevented from being touched by mistake when the user carries the electronic cigarette, thus the electronic cigarette can work normally. Furthermore, the sleeve 101 is fixed by the locating member 102, thus the sleeve 101 can be slid smoothly. Moreover, the sleeve 101 is connected to the electronic cigarette body by the non-metallic stopping member 104, and the non-metallic stopping member 104 does not scratch or damage the surface of the electronic cigarette body, thereby facilitating user's use, improving the user's experience and prolonging a service life of the electronic cigarette.

In the embodiment of the present application, the sleeve 101 may be made of magnetic material such as iron, cobalt, nickel or their alloy, which can generate an attraction force with the magnet, or the sleeve 101 is provided with the magnetic material such as iron, cobalt, nickel or their alloy. The locating member 102 is fixedly connected to the electronic cigarette body 100, and the magnetic attraction force generated by the locating member 102 attracts the sleeve 101, thus the sleeve 101 is connected to the locating member 102 by the magnetic attraction force and slides on the exterior of the electronic cigarette under a pushing force of the user.

For fully describing the present application, the following embodiments are specifically described and the above-mentioned technical features can be used in the followings embodiments.

Figure 2:
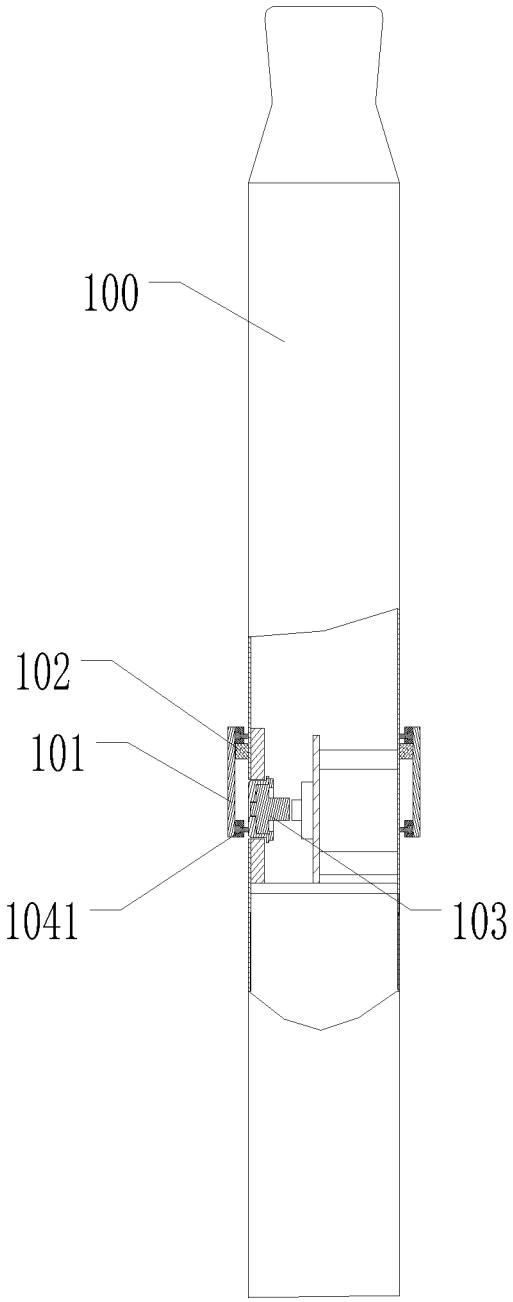
FIG. 2 is a schematic view showing an embodiment of the electronic cigarette according to the present application.

Reference is made to FIG. 2, which illustrates the first embodiment. Each of the two ends of the sleeve 101 is further provided with a magnetic ring 1041 protruding from the inner surface of the sleeve 101, and the magnetic ring 1041 may be made of magnetic material such as iron, cobalt, nickel or their alloy or the magnet.

The magnetic ring 1041 is provided with a hollow cavity.

An inside of the hollow cavity is provided with a non-metallic stopping member 104 which protrudes from the hollow cavity and is connected to the surface of the electronic cigarette body.

The locating member 102 is a magnet which is connected to the magnetic ring by a magnetic attraction force, and is configured to obstruct a free sliding of the sleeve on the electronic cigarette body when the sleeve 101 uncovers or covers the functional element 103.

In this embodiment, the non-metallic stopping member 104 is arranged inside the hollow cavity of the magnetic ring 1041, and has a protruding portion outside the hollow cavity, by which portion the non-metallic stopping member 104 is slidably connected to the surface of the electronic cigarette body 100. The non-metallic stopping member 104 may be silica gel or rubber, that is, the non-metallic stopping member 104 may be made of silica gel or rubber. Since the silica gel or rubber is soft and wear-resistant, when the non-metallic stopping member 104 is in contact with the surface of the electronic cigarette body 100, no matter in a sliding situation or a non-sliding situation, the surface of the electronic cigarette body 100 is not scratched. The non-metallic stopping member 104 and the magnetic ring 1041 are firmly connected by adopting the connection manner of arranging the non-metallic stopping member 104 inside the hollow cavity of the magnet, and when the non-metallic stopping member 104 slides with respect to the electronic cigarette body 100, the non-metallic stopping member 104 does not fall off due to a long use of the electronic cigarette.

In this embodiment, the hollow cavity of the magnetic ring 1041 may be a hollow cavity arranged in the whole magnet or hollow cavities arranged in the magnet in sections. If the hollow cavity is the hollow cavities arranged in sections, there are at least four hollow cavities. This is because the sliding connection between the non-metallic stopping member 104 and the electronic cigarette may be adversely affected if the number of the hollow cavities is less than four. Of course, no matter the hollow cavity is arranged in the whole the magnet or the hollow cavities are arranged in the magnet in sections, the non-metallic stopping member is always filled in the hollow cavity and slidably connected to the electronic cigarette body.

In this embodiment, the locating member 102 is made of the magnetic material or the magnet and may generate the magnetic attraction force with the magnet on the non-metallic stopping member. In a case that the user needs to use the functional element 103, the sleeve 101 is removed and is reliably fixed by the magnetic attraction force generated between the locating member 102 and the sleeve 101, thereby preventing the sleeve 101 from sliding freely and adversely affecting user's use. Similarly, in a case that the user covers the functional element 103, the sleeve 101 is reliably fixed by the magnetic attraction force generated between the locating member 102 and the sleeve 101, thereby preventing the sleeve 101 from sliding freely to slide away and exposing the functional element 103.

Figure 3:
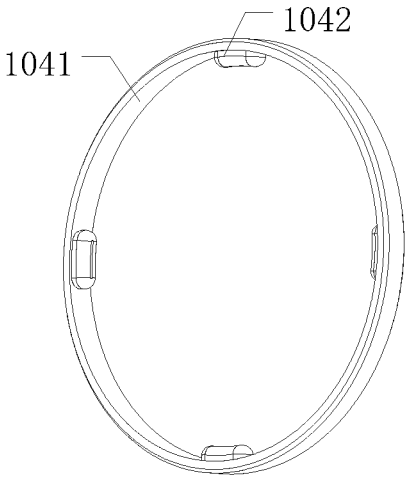
FIG. 3 is a schematic view showing an embodiment of the structure of a non-metallic stopping ring of the electronic cigarette according to the present application.

Reference is made to FIG. 3, in this embodiment, a middle portion of the magnetic ring 1041 is provided with at least three T-shaped hollow cavities 1042.

An inside of each of the T-shaped hollow cavities 1042 is provided with the non-metallic stopping member 104, which protrudes from the respective T-shaped hollow cavity 1042 and is in contact with the surface of the electronic cigarette body.

Figure 5:
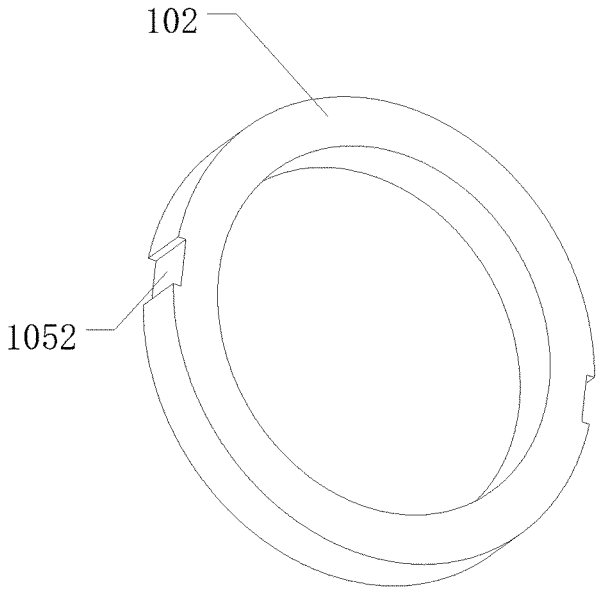
FIG. 5 is a schematic view showing an embodiment of the structure of a locating ring of the electronic cigarette according to the present application.

Reference is made to FIG. 5, in this embodiment, a middle portion of the magnetic ring 1041 is provided with at least three T-shaped hollow cavities 1042. The inside of each T-shaped hollow cavity 1042 is provided with the non-metallic stopping member 104 which protrudes from the T-shaped hollow cavity 1042 and is in contact with the surface of the electronic cigarette body. The non-metallic stopping member 104 is arranged inside the T-shaped hollow cavity 1042 of the magnetic ring 1041. The non-metallic stopping member inside the T-shaped hollow cavity 1042 has a large area, and two end surfaces of the T-shape at a T-shaped opening have a function of preventing the non-metallic stopping member 104 from dropping out from the hollow cavity, and the protruding portion of the non-metallic stopping member 104 extends from the T-shaped opening and is connected to the electronic cigarette body. Such a structure allows the magnetic ring 1041 to be firmly connected to the non-metallic stopping member 104 and not apt to drop out from the magnet, thus the phenomenon that the non-metallic stopping member falls off due to the long use of the electronic cigarette may not happen. Therefore, compared with the non-metallic stopping member 104 directly arranged on the ends of the magnet or other fixing manners, the fixing manner of adopting the T-shaped hollow cavity is firmer and more durable, and the non-metallic stopping member 104 may not fall off from the non-metallic stopping member when the sleeve 101 repeatedly uncovers or covers on the electronic cigarette body.

In this embodiment, the middle portion of the magnetic ring 1041 may be provided with three, four or five T-shaped hollow cavities 1042. In this embodiment, it is preferable to provided with four T-shaped hollow cavities 1042. Because the middle portion of the magnetic ring 1041 provided with four T-shaped hollow cavities 1042 allows the sleeve 101 to stably slide on the electronic cigarette body and not apt to shake. If too many T-shaped hollow cavities 1042 are provided, a manufacturing workload is increased while the effect is the same as that of setting four T-shaped hollow cavities 1042. The specific number is not limited herein.

In this embodiment, the non-metallic stopping member 104 slides on the electronic cigarette body in a point contact manner. The point contact has a smaller sliding friction force than a surface contact, thus it is convenient to use for the user.

Figure 4:
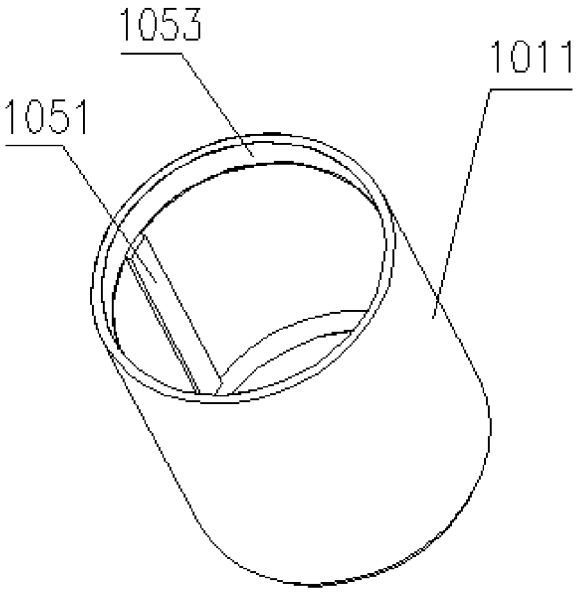
FIG. 4 is a schematic view showing an embodiment of the structure of a sleeve of the electronic cigarette according to the present application.

Another embodiment according to the present application may refer to FIGS. 4 and 5.

The sleeve is the sleeve 101 which is sleeved on the electronic cigarette body and thus the assembly is convenient and the connection is stable. The non-metallic stopping member 104 is the non-metallic stopping member 104 which protrudes from the inner surface of the sleeve 101 and is located in the circumference of the electronic cigarette body 100. The non-metallic stopping member 104 is inserted into an annular groove 1053 of the sleeve 101. The locating ring 102 is a locating ring 102 sleeved on the circumference of the electronic cigarette body 100. The locating ring 102 is arranged between the non-metallic stopping members 104 and is configured to abut against the non-metallic stopping member 104 to restrict a sliding distance of the sleeve 101.

In this embodiment, the circumferential locating ring 102 is provided with at least two sliding grooves 1052, and the sleeve 101 is further provided with sliding rails 1051 which match with the sliding groove and are axially slide relative to the electronic cigarette body 100.

The non-metallic stopping members 104 are arranged at two ends of the sliding rails respectively.

The sliding rails 1051 are arranged in the axial direction of the electronic cigarette body 100.

In this embodiment, each of the two ends of the sleeve 101 is provided with a magnetic ring made of magnet, and a middle portion of the magnetic ring is provided with a hollow cavity. The non-metallic stopping member 104 is arranged inside the hollow cavity and is provided with a protruding portion which protrudes from the hollow cavity and is in contact with the surface of the electronic cigarette body. The non-metallic stopping member may be made of silica gel or rubber. Since the silica gel or rubber is soft and wear-resistant, when the non-metallic stopping member is in contact with the surface of the electronic cigarette body 100, no matter in a sliding situation or a non-sliding situation, the surface of the electronic cigarette body 100 is not scratched. The non-metallic stopping member and the magnetic are firmly connected by using the connection manner of arranging the non-metallic stopping member inside the hollow cavity of the magnet, and when the non-metallic stopping member slides with respect to the electronic cigarette body, the non-metallic stopping member does not fall off due to the long use of the electronic cigarette.

In the present application, the sleeve 101 is slidable with respect to the electronic cigarette body 100. In a case that the user needs to use the functional element 103, the sleeve 101 is slid; and in a case that the user does not need to use the functional element 103, the sleeve 101 covers the functional element 103 and has a protective function, therefore the functional element 103 is prevented from being exposed and being touched by mistake when the user carries the electronic cigarette, thus the electronic cigarette can normally work.

In this embodiment, the length of the sleeve 101 along the electronic cigarette body may be set to be equal to or slightly larger than the length of the functional element 103. The length is not limited herein as long as the sleeve can cover all of the functional elements.

In this embodiment, the locating ring 102 is fixed on the electronic cigarette body 100 and is arranged in the sleeve 101 between the non-metallic stopping members 104. For preventing the sleeve 101 from sliding off the electronic cigarette body 100, a circumferential width, that is, a thickness of the locating ring 102 is set such that the locating ring 102 can be just in contact with the inner surface of the sleeve 101 or is a predetermined distance from the inner surface of the sleeve 101. The circumferential width, that is, the thickness of the non-metallic stopping member 104 allows lateral sides of the non-metallic stopping member 104 and the locating ring 102 to be in contact with each other when the sleeve 101 slides to one end. No matter the sleeve 101 axially slides or circumferentially slides, the lateral sides of the non-metallic stopping member 104 and the locating ring 102 can always be in contact with each other, therefore the sleeve 101 is prevented from sliding continually and thus the sleeve 101 is prevented from sliding off the electronic cigarette body 100.

In this embodiment, the sleeve 101 slides on the electronic cigarette body 100 by the sliding rail 1051 matching with the sliding groove 1052, and a sliding distance of the sleeve 101 can cover the functional elements. Thus after the sleeve 101 is slid, the using of the functional elements 103 may not be adversely affected. For a better cooperation between the sliding rail 1051 and the sliding groove 1052, cross sections of the sliding rail 1051 and the sliding groove 1052 are set to be trapezoid, thus the sliding rail 1051 is wedged into the sliding groove 1052 and the connection is firm.

In this embodiment, the number of the sliding grooves 1052 of the locating ring 102 may be set to be three or four and so on. The sliding grooves 1052 with a large number can steady the connection between the sliding rails 1051 and the sliding grooves 1052, that is, can allow the sleeve 101 and the electronic cigarette body to be firmly connected. In this embodiment, the number of the sliding grooves 1052 is preferably set to be three. Because the arrangement of three sliding grooves 1052 is steady and the sleeve 101 may not shake on the electronic cigarette body 100. Furthermore, if more sliding grooves 1052 are provided, more troubles may be brought to manufacturing. Similarly, three sliding grooves 1052 match with three sliding rails. The specific number is not limited herein.

In this embodiment, the locating ring 102 has magnetic material, and the magnet of the non-metallic stopping member 104 and the magnetic material of the locating ring 102 generate a magnetic attraction force, which allows the sleeve 101 to be reliably connected at two ends. When the sleeve 101 slides to one end to uncover the functional element 103 and the user operates the functional element 103, since the magnet of the non-metallic stopping member 104 and the magnetic material of the locating ring 102 attract each other, the sleeve is tightly abutted at this end and can not slide freely to prevent from adversely affecting the user to use the functional element. Similarly, after the sleeve covers the functional element, because the magnet of the non-metallic stopping member 104 and the magnetic material of the locating ring 102 attract each other, the sleeve 101 fixedly covers the functional element 103 and does not automatically slide.

In this embodiment, the sleeve 101 is made of plastic material. Because of the magnets on the two ends of the sleeve and the locating ring 102 using the magnet and/or magnetic material, the sleeve using non-magnetic material can avoid being attracted by the magnet and adversely affecting user's using. Since the plastic material is wear-resistant and the sleeve is arranged on the exterior of the electronic cigarette body 100, for a suitable touch feeling of the user, it is preferable to use the plastic material. Of course, other material can also be used, which is not limited herein.

In the present application, there is another embodiment which differs from the above embodiments in that: sliding directions of the sleeve 101 are different. In the above embodiments, the sleeve 101 slides in the axial direction of the electronic cigarette body 100 while in this embodiment the sleeve 101 slides in the circumference direction of the electronic cigarette body 100. However, the sleeve 101 has the same functions.

The sleeve 101 is provided with an opening via which the user can use the functional element 103. The sleeve is provided with at least two circumferential grooves in a circumference direction of the electronic cigarette body 100.

A locating member 102 is provided with circumferential bosses matching with the circumferential grooves. The sleeve 101 is slidable along the circumference of the electronic cigarette body by the circumferential grooves matching with the circumferential bosses.

In this embodiment, the locating member is provided with the bosses and the sleeve 101 is provided with the grooves matching with the bosses. Both the grooves and the bosses are in the circumferential direction of the electronic cigarette body. The number of the bosses may be two, three or four and the specific number is not limited herein. The number of the grooves matches with the number of the bosses.

In this embodiment, the sleeve 101 is provided with an opening which has an area equal to or larger than an area of the functional element 103. In a case that the sleeve 101 rotates in the circumference direction and the opening coincides with the functional element 103, the user can use the functional element 103. If the user does not use the functional element 103, the sleeve 101 is rotated in the circumference direction to allow the opening to rotate away from the functional element 103, thus a protection function is realized.

In this embodiment, the sleeve 101 is further provided with non-metallic stopping members which are respectively located at two sides of the opening and are in the axial direction of the electronic cigarette body. The electronic cigarette body is further provided with a locating member which matches with the non-metallic stopping member and is used for restricting a sliding range of the sleeve.

The non-metallic stopping members are arranged at the two sides of the opening respectively, the locating member is arranged between the two non-metallic stopping members, and the two non-metallic stopping members and the locating member is allowed to be in contact with each other to obstruct the circumferential sliding of the sleeve, thus a circumferential sliding distance of the sleeve can be controlled between the two non-metallic stopping members. A distance between the two non-metallic stopping members is the area of the functional element and can also be slightly larger than the area of the functional element. Such manner facilitates the user's using and avoids rotating the opening of the sleeve to find the functional element by the user.

In this embodiment, each non-metallic stopping member includes glue material such as a silica gel part or a rubber part, the non-metallic stopping member is fixed with a magnet. The locating member is made of magnetic material. By adopting the way of the magnet and the magnetic material attracting each other, after the user aligns the opening with the functional element, the user operates the functional element. Because the magnet on the non-metallic stopping member and the locating ring 102 attract each other, the sleeve is tightly abutted at this side and can not slide freely to avoid affecting the user to use the functional element. Similarly, after the sleeve covers the functional element, the magnet on the non-metallic stopping member and the locating ring 102 attract each other, the sleeve fixedly covers the functional element 103 and does not automatically slide.

Of course, in another embodiment of the present application, the non-metallic material may be provided with the magnetic material and the locating member is set to be the magnet. The specific working manner and the effect are the same as those in the above description and are not described again herein.

In this embodiment, two ends of the sleeve may be provided with magnets respectively, a middle portion of each magnet is provided with a hollow cavity, the non-metallic stopping member is arranged in the hollow cavity and is slidably connected to the electronic cigarette body. The non-metallic stopping member may not scratch or damage the surface of the electronic cigarette body, the non-metallic stopping member is arranged inside the hollow cavity of the magnet, and the connection to the magnet is firmer, thereby facilitating user's use, improving the user's experience and prolonging the service life of the electronic cigarette.

Figure 6:
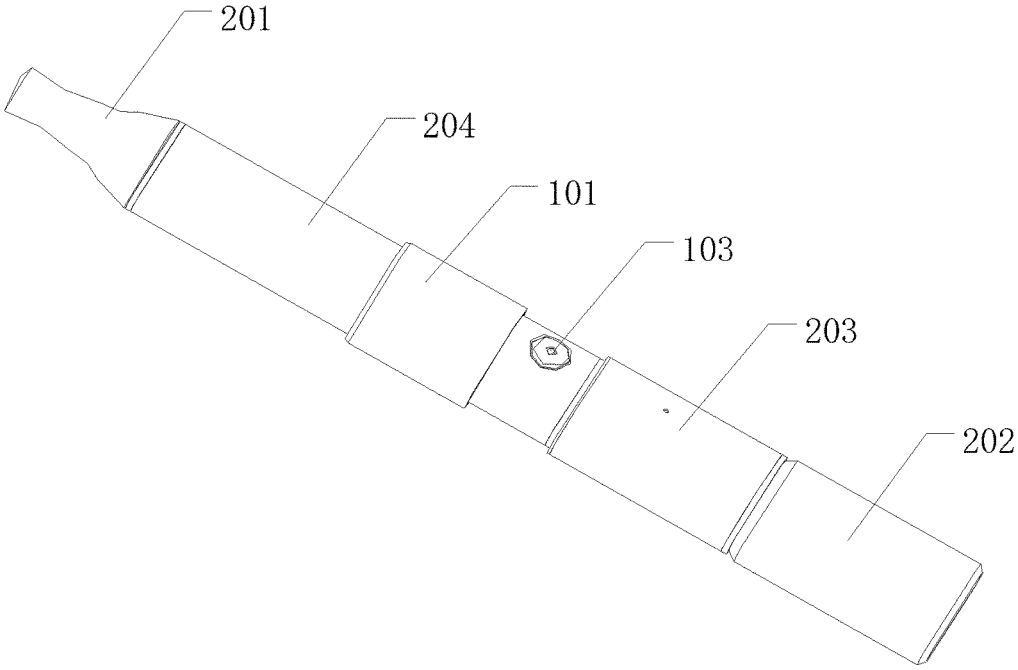
FIG. 6 is a schematic view showing the overall structure of an electronic cigarette according to another preferable embodiment of the present application.

Reference is made to FIG. 6, which is a schematic view showing the overall structure of an electronic cigarette according to the present application. The electronic cigarette in FIG. 6 further includes:

a smoking end 201 by which the user can smoke;

a liquid container 202 for containing a cigarette liquid, in which a cigarette liquid which can be atomized is contained; and an atomizing assembly 203 for atomizing the cigarette liquid, by which the cigarette liquid in the liquid container 202 is allowed to be atomized.

A smoke passage (not shown) for flowing of atomized cigarette liquid is further formed in the electronic cigarette body, thus allowing the user to inhale, by the smoking end 201, the cigarette liquid flowing through the smoke passage.

The electronic cigarette body further includes a battery rod assembly 204 for supplying power to the atomizing assembly 203.

The functional element 103 is arranged on the atomizing assembly or the battery rod assembly.

As shown in FIG. 6, the liquid container 202 is arranged on one end of the electronic cigarette body, which end is away from the smoking end 201. The advantage of adopting this arrangement is that, the liquid container 202 is arranged to be away from the smoking end 201, which makes the smoke passage in the electronic cigarette body not pass through the liquid container 202, thus the cigarette liquid in the liquid container 202 which is not atomized may not leak into the smoke passage, and then the user may not inhale the cigarette liquid which is not atomized, thereby the cigarette liquid leakage is effectively prevented. The smoke passage which does not pass through the liquid container 202 can further prevent the smoke from being condensed in the smoke passage and thus can effectively prevent condensed cigarette liquid from blocking the smoke passage.

In conjunction with FIG. 6, a specific structure of the electronic cigarette according to this embodiment is further described in detail. The atomizing assembly 203 is located between the battery rod assembly 204 and the liquid container 202, and the smoking end 201 is located at an outside of an end of the battery rod assembly 204 or is located at a middle portion of the battery rod assembly 204 or at a position which is away from the atomizing assembly 203 on the battery rod assembly 204.

Specifically, the smoking end 201 located at the outside of an end of the battery rod assembly 204 is coaxially arranged with the battery rod assembly 204. According to this arrangement manner, the shape of the electronic cigarette intuitively simulates a real cigarette and the entire smoke passage is straight, thereby effectively avoiding the phenomenon of oil accumulation.

Or the smoking end 201 is located at the middle portion of the battery rod assembly 204 or at the position which is away from the atomizing assembly 203 on the battery rod assembly 204.

In this embodiment, the specific position of the smoking end 201 is not limited.

In this embodiment, for making the overall structure of the electronic cigarette simulate the real cigarette, meeting user's using habit and decreasing the oil accumulation, the atomizing assembly 203 is coaxially arranged with the battery rod assembly 204.

Of course, a specific arrangement is not limited in this embodiment. For example, the battery rod assembly 204, the atomizing assembly 203 and the liquid container 202 which are successively connected may be staggered, thus allowing the entire appearance of the electronic cigarette to be shaped and the shaped appearance may be any shape.

The atomizing assembly 203 and the battery rod assembly 204 may be non-coaxially arranged, that is, the liquid container 202 and the atomizing assembly 203 adopt a parallel arrangement, and the liquid container 202 and the atomizing assembly 203 are respectively connected to the battery rod assembly 204, and the overall structure of the electronic cigarette is T-shaped.

In this embodiment, the overall shape and structure of the electronic cigarette are not limited as long as the liquid container 202 is arranged at the position away from the smoking end 201.

In this embodiment, the atomizing assembly 203 is located between the battery rod assembly 204 and the liquid container 202, that is, the atomizing assembly 203 is away from a position of the smoking end 201. When the user smokes with the electronic cigarette according to this embodiment, a position of the atomizing assembly 203 is away from a position of user's mouth, therefore heat generated when the atomizing assembly 203 atomizes the cigarette liquid does not scald the user, thereby effectively improving the using security of the electronic cigarette. During smoking, the user generally holds the battery rod assembly 204 to smoke and avoids holding an exothermic atomizing assembly 203 to smoke in the prior art, therefore the user's hand is not scalded when using the electronic cigarette according to this embodiment, the temperature of the real cigarette is effectively simulated and the user's using experience during smoking is improved.

Preferably, the liquid container 202 and the atomizing assembly 203 are detachably connected and/or the atomizing assembly 203 and the battery rod assembly 204 are detachably connected.

Specifically, the detachable connection of the liquid container 202 and the atomizing assembly 203, and/or the atomizing assembly 203 and the battery rod assembly 204 may be a threaded connection or a snap connection. The specific connection manner is not limited in this embodiment as long as the liquid container 202 and the atomizing assembly 203, and/or the atomizing assembly 203 and the battery rod assembly 204 can be detachably connected.

The advantages of using the above detachable connection is that it is convenient for the user to change the atomizing assembly 203 or detach the liquid container 202 at any time, thus it is convenient for the user to fill the liquid container 202 with a cigarette liquid or change the liquid container 202. Of course, the connection manner of the liquid container 202 and the atomizing assembly 203, and/or the atomizing assembly 203 and the battery rod assembly 204 may be an un-detachable connection manner, which is not limited herein.

In this embodiment, the atomizing assembly 203 includes a heating wire assembly (not shown) which is configured to atomize the cigarette liquid and is electrically connected to a battery in the battery rod assembly 204, and a liquid guide device (not shown) which is configured to convey the cigarette liquid in the liquid container to the heating wire assembly to be atomized. The liquid guide device has one end inserted into the liquid container 202 and another end extending to the outside of the liquid container. The heating wire assembly is located at an end of the liquid guide device, which end is adjacent to the battery rod assembly 204. The liquid guide device includes a liquid guide wick made of cotton or fiber, which is not limited herein.

In the present application, the sleeve is configured to cover the functional element 103. A position of the sleeve is determined according to the functional element 103 and may be on a surface of the atomizing assembly or a surface of the battery rod assembly.

The technical solutions in the embodiments of the present application will be described clearly and completely hereinafter in conjunction with the drawings in the embodiments of the present application. Apparently, the described embodiments are only a part of the embodiments of the present application, rather than all embodiments. Based on the embodiments in the present application, all of other embodiments, made by the person skilled in the art without any creative efforts, fall into the scope of the present application.

The above embodiments are described in a progressive manner. Each of the embodiments is mainly focused on describing its differences from other embodiments, and references may be made among these embodiments with respect to the same or similar portions among these embodiments.

Based on the above description of the above described embodiments, those skilled in the art is capable of carrying out or using the present application. It is obvious for those skilled in the art to make many modifications to these embodiments. The general principle defined herein may be applied to other embodiments without departing from the spirit or scope of the present application. Therefore, the present application is not limited to the embodiments illustrated herein, but should be defined by the broadest scope consistent with the principle and novel features disclosed herein.

What is claimed is:

1. An electronic cigarette, comprising an electronic cigarette body, the electronic cigarette body being provided with a functional element, a sleeve and a first locating member, wherein:

the sleeve is slidably connected to the electronic cigarette body and configured to cover the functional element;

the first locating member is fixed on the electronic cigarette body and located between the sleeve and the electronic cigarette body, and is configured to make the sleeve be slidably connected to the electronic cigarette body;

two ends of the sleeve are provided with first non-metallic stopping members respectively, which protrude from an inner surface of the sleeve and are in contact with a surface of the electronic cigarette body; and the first locating member is located between the first non-metallic stopping members and is configured to abut against the first non-metallic stopping members to limit a sliding distance of the sleeve and prevent the sleeve from sliding off the electronic cigarette body.

2. The electronic cigarette according to claim 1, wherein, the two ends of the sleeve are further provided with magnetic rings protruding from the inner surface of the sleeve, respectively;

each magnetic ring is provided with a hollow cavity;

an inside of the hollow cavity is provided with the first non-metallic stopping member which protrudes from the hollow cavity and is connected to the surface of the electronic cigarette body; and the first locating member is a magnet connected to the magnetic ring by a magnetic attraction force, and is configured to obstruct a free sliding of the sleeve on the electronic cigarette body when the sleeve uncovers or covers the functional element.

3. The electronic cigarette according to claim 2, wherein, a middle portion of the magnetic ring is provided with at least three T-shaped hollow cavities; and an inside of each T-shaped hollow cavity is provided with the first non-metallic stopping member which protrudes from the T-shaped hollow cavity and is in contact with the surface of the electronic cigarette body.

4. The electronic cigarette according to claim 1, wherein, the first locating member is provided with at least two sliding grooves;

the sleeve is further provided with sliding rails which match with the sliding grooves and axially slide relative to the electronic cigarette body;

the first non-metallic stopping members are arranged at two ends of each sliding rail; and the sliding rails are arranged in an axial direction of the electronic cigarette body.

5. The electronic cigarette according to claim 1, wherein, the sleeve is provided with an opening via which the user uses the functional element;

the sleeve is provided with at least two circumferential grooves in a circumference direction of the electronic cigarette body;

the first locating member is provided with circumferential bosses matching with the circumferential grove; and the sleeve slides circumferentially along the electronic cigarette body by the circumferential grooves matching with the circumferential bosses.

6. The electronic cigarette according to claim 5, wherein, the sleeve is further provided with second non-metallic stopping members which are located at two sides of the opening respectively and are in the axial direction of the electronic cigarette body; and the electronic cigarette body is further provided with a second locating member matching with the second non-metallic stopping members and configured to restrict a sliding range of the sleeve.

7. The electronic cigarette according to claim 1, wherein the functional element comprises a button and/or a display screen.

8. The electronic cigarette according to claim 1, wherein the first non-metallic stopping member is made of silica gel or rubber.

9. The electronic cigarette according to claim 1, wherein, the first locating member comprises an upper portion and a lower portion;

the upper portion is in contact with the sleeve and is made of silica gel or rubber; and the lower portion is connected to the electronic cigarette body and is made of magnetic material.

10. The electronic cigarette according to claim 1, wherein, the two ends of the sleeve are provided with grooves each having a trapezoid cross section and configured to receive the first non-metallic stopping members; and the first non-metallic stopping members and the sleeve are connected in a detachable manner.

11. The electronic cigarette according to claim 1, wherein, the electronic cigarette further comprises a smoking end, an liquid container configured to contain a cigarette liquid, an atomizing assembly for atomizing the cigarette liquid and a battery rod assembly for supplying power to the atomizing assembly;

the liquid container is arranged on an end of the electronic cigarette body away from the smoking end; and the functional element is arranged on the atomizing assembly or the battery rod assembly.

12. The electronic cigarette according to claim 11, wherein the atomizing assembly is located between the battery rod assembly and the liquid container, and the smoking end is located at an outside of an end of the battery rod assembly or is located at a middle portion of the battery rod assembly or at a position which is away from the atomizing assembly on the battery rod assembly.

13. The electronic cigarette according to claim 11, wherein, the liquid container and the atomizing assembly are detachably connected;

and/or the atomizing assembly and the battery rod assembly are detachably connected.

14. The electronic cigarette according to claim 11, wherein the atomizing assembly and the battery rod assembly are coaxially arranged.

15. The electronic cigarette according to claim 11, wherein, the atomizing assembly comprises a heating wire assembly configured to atomize the cigarette liquid; and a liquid guide device configured to convey the cigarette liquid in the liquid container to the heating wire assembly to be atomized.

16. The electronic cigarette according to claim 11, wherein a surface of the atomizing assembly or the battery rod assembly is provided with the sleeve configured to cover the functional element.

* * * * *